US006482024B1

(12) United States Patent
Revis

(10) Patent No.: US 6,482,024 B1
(45) Date of Patent: Nov. 19, 2002

(54) RELEASABLE FASTENING DEVICE, SUCH AS FOR AN ELECTRICAL COMPUTER CONNECTOR, AND METHODS FOR RELEASABLE FASTENING AND ELECTRICAL COMPUTER CONNECTOR TO A COMPUTER COMPONENT

(75) Inventor: Paul A. Revis, Meridian, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/339,398

(22) Filed: Jun. 23, 1999

(51) Int. Cl.[7] ..... H01R 13/625
(52) U.S. Cl. ..... 439/348; 439/953
(58) Field of Search ..... 439/348, 346, 439/372, 265, 953

(56) References Cited

U.S. PATENT DOCUMENTS

| | | | | |
|---|---|---|---|---|
| 4,589,716 A | * | 5/1986 | Williams, II | 439/348 |
| 4,781,330 A | | 11/1988 | Atkins | |
| 5,098,312 A | | 3/1992 | Raczynski | |
| 5,190,465 A | | 3/1993 | Davidge et al. | |
| 5,219,242 A | | 6/1993 | Liaw | |
| 5,288,241 A | | 2/1994 | Davidge et al. | |
| 5,288,244 A | | 2/1994 | Lien | |
| 5,383,792 A | | 1/1995 | Falossi et al. | |
| 5,411,401 A | | 5/1995 | Chiou | |
| 5,452,975 A | | 9/1995 | Grant | 411/22 |
| 5,554,045 A | * | 9/1996 | Bethurum | 439/372 |
| 5,562,458 A | * | 10/1996 | Stora et al. | 439/348 |
| 5,775,931 A | | 7/1998 | Jones | |
| 5,863,781 A | * | 11/1998 | Hyzin | 439/348 |
| 5,921,801 A | | 7/1999 | O'Sullivan et al. | |
| 6,095,845 A | | 8/2000 | Murphy | |
| 6,116,942 A | * | 9/2000 | Chen et al. | 439/348 |

* cited by examiner

*Primary Examiner*—Khiem Nguyen
*Assistant Examiner*—J. F. Duverne
(74) *Attorney, Agent, or Firm*—Perkins Coie LLP

(57) ABSTRACT

A fastener for fastening and releasing a first electrical contact on a cable with a second electrical contact on a computer component, and a method for fastening and releasing the first and second electrical contacts, are shown and described. The computer component generally has an attachment orifice defining a fastening axis. In one embodiment, the fastener has a body, an elongated casing, an engagement element and an actuator. The elongated casing can project from the body along the fastening axis when the first and second electrical contacts are aligned for engagement. The engagement element can be positioned along the casing at a location spaced apart from the body. The casing and/or the engagement element is movable between release and fasten positions. In the release position, the engagement element is generally near the fastening axis and the casing and/or the engagement element is generally configured to be received in the attachment orifice. In the fasten position, the engagement element is generally spaced laterally apart from the fastening axis. The actuator can have a first end accessible to a user, a second end adjacent to the casing and a drive surface at the second end that can contact the engagement element and/or the casing. The actuator can be slidably coupled to the body to move only axially between a first position and a second position. When the actuator is in the first position, the engagement element is in the release position and can be received in the attachment orifice. When the actuator is in the second position, the drive surface on the actuator moves the engagement element and/or the casing to the fasten position and retain the cable in electrical contact with the computer component.

36 Claims, 9 Drawing Sheets

RELEASABLE FASTENING DEVICE, SUCH AS FOR AN ELECTRICAL COMPUTER CONNECTOR, AND METHODS FOR RELEASABLE FASTENING AND ELECTRICAL COMPUTER CONNECTOR TO A COMPUTER COMPONENT

TECHNICAL FIELD

The invention is directed to electrical connectors for computer components and, more particularly, to a fastener for releasably retaining the electrical connector in engagement with the computer component, and to methods for releasably retaining electrical connectors in engagement with computer components.

BACKGROUND OF THE INVENTION

A typical computer system includes a central processing unit ("CPU"), a plurality of input devices, (e.g., a keyboard and a mouse) and a plurality of output devices (e.g., a display and a printer). Each input/output device is generally connected by a cable to a particular input or output port on the CPU. The cable has an electrical contact configured to engage the port on the CPU. Various sizes and shapes of electrical contacts and ports have been created to accommodate the different types of input or output devices and to prevent the cables from being connected to the wrong port on the CPU.

Once the connector is engaged with the CPU, the connector is often locked into place to prevent the electrical contact from separating from the port. Traditionally, a threaded bolt has been used to lock the connector to the CPU. The threaded bolt has a head at a first end and a threaded rod at an opposing second end. The threaded rod is inserted through a hole in the connector and threadedly engaged with a complementary, threaded opening in the CPU. The head is often textured to help grip and rotate the bolt in the threaded opening. By tightening the threaded bolts on either side of the connector, the connector is locked in place with the electrical contact engaged with the port.

Such threaded bolt connectors can be difficult to manipulate. The input/output ports are typically positioned on the back panel of the CPU and are therefore often located adjacent a wall or beneath a desk. In such situations, the individual must reach behind the CPU and/or under the desk and rotate the threaded bolt to lock or unlock the connector from the port. Rotating the threaded bolt under these circumstances can be difficult.

One existing connector directed to solving this problem is disclosed in U.S. Pat. No. 5,452,975 issued to Grant ("Grant"), which is herein incorporated by reference. Grant discloses a connector including an elongated, hollow connector housing having a distal end that projects from the connector to engage the threaded opening in the computer component. The connector housing has an interior volume and one or more egress openings at its distal end. A pressure-extrudable material (e.g., polyurethane) is positioned in the interior volume at the distal end of the connector housing. An occlusion element is positioned within the interior volume proximal of the pressure-extrudable material. When the occlusion element is moved toward the distal end of the connector housing, the pressure-extrudable material is compressed and partially extruded through the egress openings. The extruded material is received within the threaded opening in the computer component and retains the connector to the computer component.

The end of the occlusion element opposite the pressure-extrudable material has an enlarged head facilitating manual manipulation of the occlusion element. The external surface of the head is similar to the traditional threaded locking member. Two opposing latches project axially in a distal direction from a distal end of the head. Each of the latches is spaced apart from the occlusion element and has a first tooth directed inward toward the occlusion element. The connector housing has two complementary rows of second teeth located to engage the first teeth on the head.

Between the two rows of second teeth on the connector housing are two opposing smooth surfaces without teeth. To move and lock the occlusion element in the distal position, the head is first moved distally with the first teeth aligned with the portion of the housing without teeth, then rotated until the first teeth engage the second teeth. Similarly, to remove the head from the connector housing and draw the occlusion element away from the pressure-extrudable material, the user rotates the head roughly 90 degrees to move the first teeth from the portion of the connector housing having the second teeth to the portion of the housing without teeth. The head is then free to move axially away from the connector housing. As the head is moved away from the connector housing, the occlusion element is likewise moved away from the pressure-extrudable material. This releases the pressure on the pressure-extrudable material and causes it to be retracted back into the tip of the housing. The connector can then be removed from the CPU.

Although Grant provides a different type of fastener for computer components, it may be difficult to operate and it may quickly wear out. Similar to the traditional threaded bolt-locking member, the Grant device must be rotated by the individual to lock and unlock the connector from the computer component. The individual removing the connector from the computer component is therefore forced to reach behind the computer component and both rotate the locking member and axially extract it from the computer. As described above, when the computer component is under a desk or against a wall, this operation can be difficult or uncomfortable. In addition, the pressure-extrudable material of the Grant device may fail after repeated use. For example, repeated extrusion of the pressure-extrudable material through the egress openings may cause this material to disintegrate or otherwise break down. Once the pressure-extrudable material breaks down to a point at which it no longer retains the connector to the computer component, the Grant device may need to be replaced.

SUMMARY OF THE INVENTION

The present invention is directed toward fasteners and methods for releasably connecting cables with computers, input devices, output devices or other computer components. Several embodiments of fasteners in accordance with the invention are used to connect a cable from a peripheral device to a computer having an attachment orifice defining a fastening axis.

In one embodiment, the fastener has a body, an elongated casing, an engagement element and an actuator. The body can have an aperture through which a first electrical contact projects and a grip configured to be manipulated by the human hand. The first electrical contact is configured to engage a complementary second electrical contact on the computer component. The elongated casing can project from the body along the fastening axis when the first and second electrical contacts are aligned for engagement. The engagement element can be positioned along the casing at a location spaced apart from the body. The casing and/or the engagement element is movable between release and fasten positions. In the release position, the engagement element is generally near the fastening axis and the casing and/or the engagement element is generally configured to be received in the attachment orifice. In the fasten position, the engagement element is generally spaced laterally apart from the fastening axis. The actuator can have a first end accessible to a user, a second end adjacent to the casing, and a drive surface at the second end that can contact the engagement element and/or the casing. The actuator can be slidably coupled to the body to move axially between a first position and a second position. When the actuator is in the first position, the engagement element is in the release position and can be received in the attachment orifice. When the actuator is in the second position, the drive surface on the actuator moves the engagement element and/or the casing to the fasten position. The fastener can be coupled to and de-coupled from a CPU solely by moving the actuator axially between the first and second positions.

In operation, at least a portion of the casing is received in the orifice and then the actuator is moved to the second position to engage the engagement element with the orifice and/or the computer component. The fastener can thus hold the connector to the computer component to retain the cable in electrical contact with the computer component without having to rotate the actuator.

DETAILED DESCRIPTION OF THE INVENTION

The present detailed description is generally directed toward fasteners for retaining electrical connectors in contact with computer components, and for methods for connecting and fastening electrical connectors to computer components. Many specific details of certain embodiments of the invention are set forth in the following description and in FIGS. 1–18 to provide a thorough understanding of such embodiments. One skilled in the art, however, will understand that the present invention may have additional embodiments, or that the invention may be practiced without several of the details described in the following description.

Figure 1:
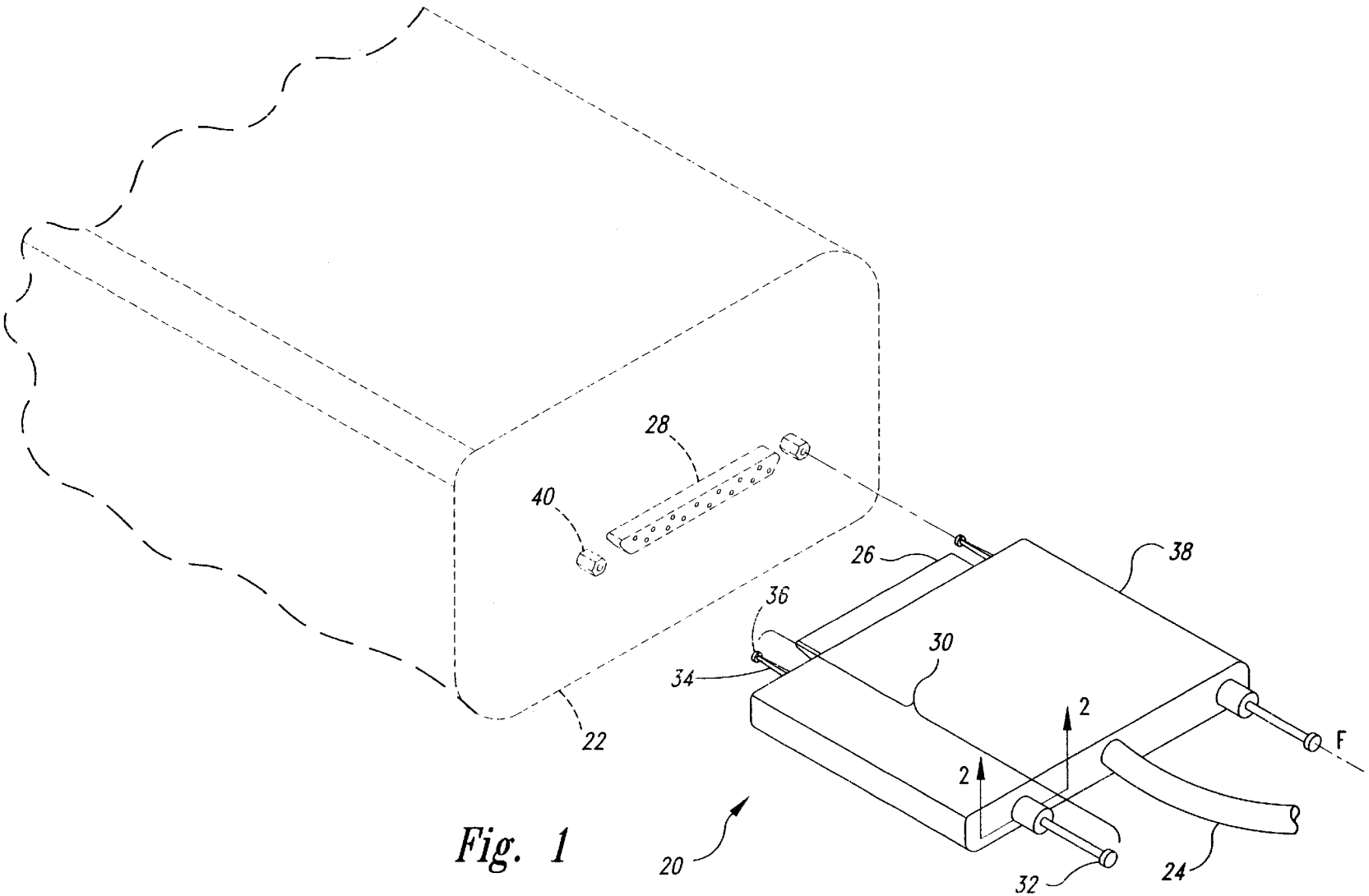
FIG. 1 is an isometric view of a portion of a computer component and an electrical connector according to one embodiment of the present invention.

FIG. 1 illustrates an electrical connector 20 in accordance with an embodiment of the invention oriented to be engaged with a computer component 22. The electrical connector 20 of this particular embodiment connects a first electrical contact 26 of a cable 24 with a second electrical contact 28 on the computer component 22. The electrical connector 20 can have a pair of fasteners 30 for releasably retaining the first electrical contact 26 in engagement with the second electrical contact 28. Each fastener 30 generally has a first actuator 32, a casing 34 and an engagement element 36. The fasteners 30 can be located on opposite sides of a body 38 of the electrical connector 20, and can be configured to engage an opening 40 on either side of the second electrical contact 28 on the computer component 22. When the electrical connector 20 is oriented so that the first electrical contact 26 is aligned with the second electrical contact 28, each of the fasteners 30 is generally aligned along a fastening axis F—F with the respective opening 40. Consequently, when the electrical connector 20 is engaged with the computer component 22, a portion of each fastener 30 can engage the respective opening 40.

As described in more detail below in connection with the operation of the fastener 30, as the first actuator 32 is depressed and released, the first actuator 32 moves between first and second positions. Movement of the first actuator 32 between the first and second positions results in movement of the casing 34 and the fastener 30 between a release position and a fasten position, respectively. In the illustrated embodiment, the first actuator 32 is in the first position and the casing 34 and fastener 30 are in the release position. In the release position, the electrical connector 20 can be engaged with or disengaged from the computer component 22. When the first actuator 32 is axially depressed and released, the first actuator can move to the second position and the casing 34 can move to the fasten position. In the fasten position, the engagement element 36 or the casing 34 can engage the opening 40 to prevent the electrical connector 20 from being disengaged from the computer component 22. When the first actuator 32 is again axially depressed and released, the first actuator returns to the first position and the casing 34 returns to the release position.

Figure 2:
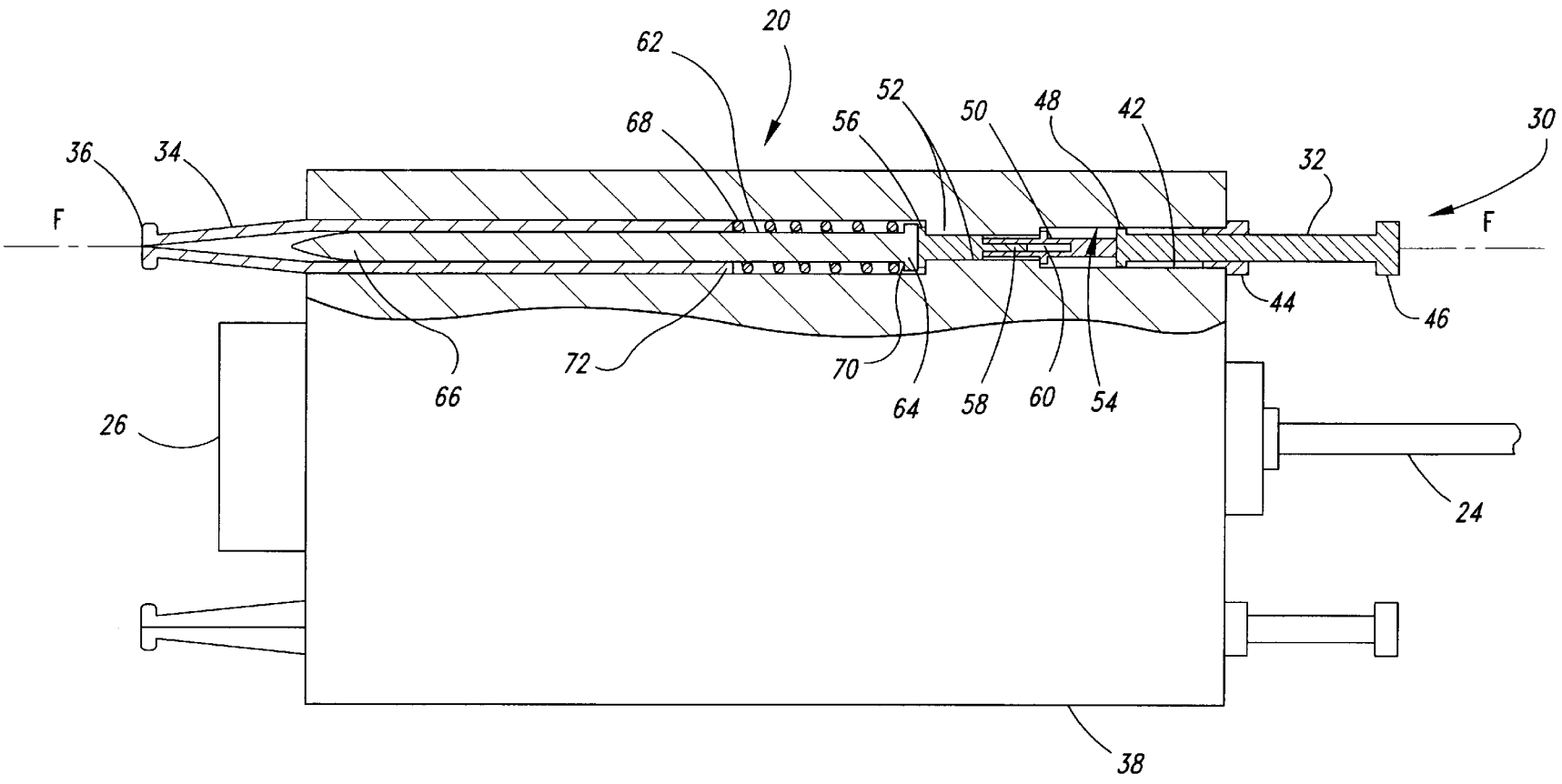
FIG. 2 is an enlarged, partial cross-sectional view of the electrical connector of FIG. 1, viewed along Section 2—2.

FIG. 2 illustrates several components of the fastener 30 and the body 38 of the electrical connector 20 in greater detail. The illustrated fastener 30 extends through an elongated aperture 42 in the body 38 of the electrical connector 20. The first actuator 32 of the fastener 30 can slidably engage a bushing 44 in the aperture 42. A proximal end 46 (generally, the end closest to the cable 24) of the first actuator 32 generally projects outward from the body 38 to be accessible to the user. A distal end 48 of the first actuator 32 can be positioned on the opposite side of the bushing 44 from the proximal end 46. The first actuator 32 can slide axially along the fastening axis F—F within the bushing 44 between the distal and the proximal ends 46, 48.

A locking assembly including a coupling 50 and a locking member 56 can be positioned within the elongated aperture 42 adjacent the distal end 48 of the first actuator 32. The locking assembly can be similar to an axial click-type lock/release mechanism in pens. As described below, the coupling 50 can moveably engage the locking member 56 to alternatingly retain the fastener 30 in the release and fasten positions. The coupling 50 can abut the distal end 48 of the first actuator 32. The coupling 50 can be slidably engaged with a plurality of internal teeth 52 projecting radially inward from an internal surface 54 of the aperture 42. The coupling 50 is generally movable along the fastening axis F—F axis with respect to the body 38. The locking member 56 can be slidably engaged with the coupling 50 and the body 38. A shaft 58 on the locking member 56 can be received in a complementary bore 60 in the coupling 50. The locking member 56 can accordingly slide along the fastening axis F—F with respect to the coupling 50 and also with respect to the body 38.

A second actuator 62 can abut the locking member 56. The illustrated second actuator 62 has a proximal end 64 that contacts the locking member 56 and an opposing distal end 66 that terminates at a point near the engagement element 36. The second actuator 62 can be slidably engaged with the casing 34 and the body 38 to move axially along the fastening axis F—F. A spring 68 can be positioned between an annular shoulder 70 at the proximal end 64 of the second actuator 62 and a proximal end 72 of the casing 34. The spring 68 generally urges the second actuator 62 against the locking member 56. The spring 68 consequently urges the locking member 56 against the coupling 50 and, in turn, the coupling 50 against the first actuator 32.

Figure 3:
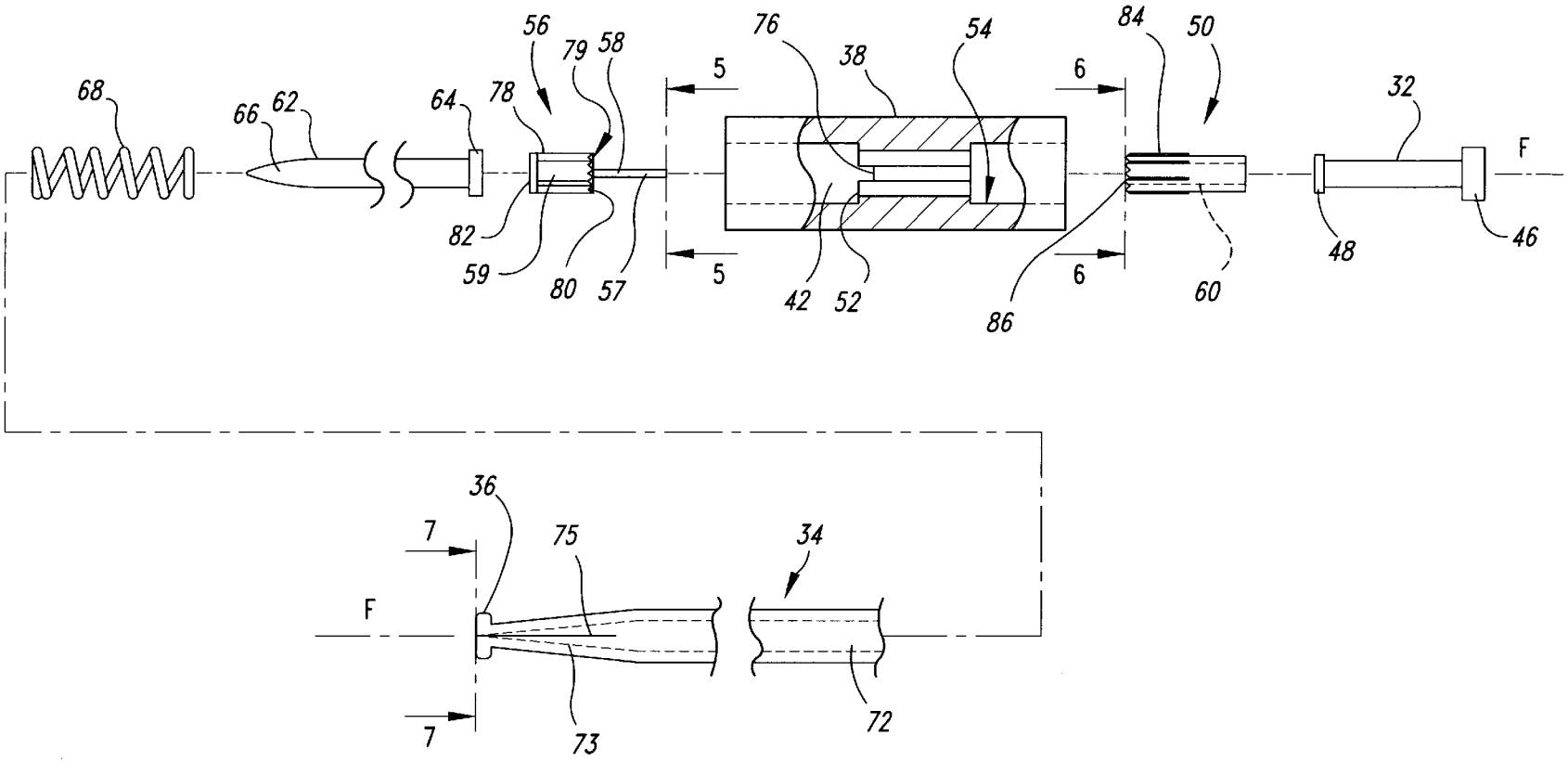
FIG. 3 is an exploded side elevation view of the electrical connector of FIG. 1.
Figure 4:
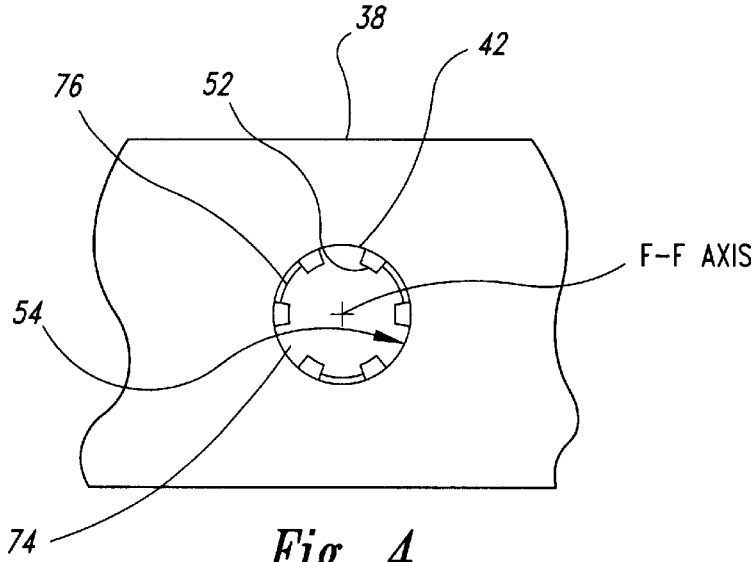
FIG. 4 is an end elevation view of a portion of a body of the electrical connector of FIG. 3.

FIGS. 3–7 still further illustrate several components of the fastener 30 in more detail. Referring to FIGS. 3 and 4, the internal teeth 52 of the body 38 are spaced around the perimeter of the internal surface 54 of the aperture 42. In the illustrated embodiment, six internal teeth 52 are evenly spaced about the internal surface 54 of the aperture 42. There may, however, be more or fewer internal teeth 52. Between each pair of internal teeth 52 can be an elongated channel 74 extending along the internal surface 54 of the aperture 42 in a direction roughly parallel to the fastening axis F—F. A locking stop 76 can be alternatingly positioned in every other channel 74 around the perimeter of the aperture 42. As best illustrated in FIG. 4, the internal teeth 52 project inwardly from the internal surface 54 by a distance greater than the locking stops 76. During operation, as discussed below, the locking member 56 can alternatingly engage the empty channels 74 and the locking stops 76, respectively, to alternatingly move the casing 34 between the release and fasten positions.

Figure 5:
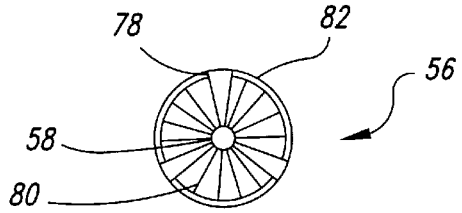
FIG. 5 is an end elevation view of a locking member of the electrical connector of FIG. 3, viewed along Section 5—5.

The locking member 56 is best illustrated in FIGS. 3 and 5. The shaft 58 can be oriented at a proximal end 57 of the locking member 56, and a distal end 59 of the locking member 56 can have a diameter larger than the shaft 58 (FIG. 3). A plurality of first external teeth 78 (FIG. 5) can project radially outward from the distal end 59 of the locking member 56. In the illustrated embodiment, three evenly spaced first external teeth 78 project from the locking member 56. There may, however, be more or fewer first external teeth 78 depending on the application. The first external teeth 78 are generally spaced to complement the spacing of the empty channels 74 or the locking stops 76. When the three first external teeth 78 are aligned with the three empty channels 74, the locking member 56 can slide axially in the proximal direction within the aperture 42 until a flange 82 impinges against the internal teeth 52 on the body 38 (FIG. 4). When the three first external teeth 78 are instead aligned with the three locking stops 76, the locking member 56 can be prevented from sliding axially in the proximal direction along the fastening axis F—F with respect to the body 38 beyond a point where the first external teeth 78 impinge upon the locking stops 76. A shoulder 79 (FIG. 3) can be created by the differing diameters between the proximal end 57 and the distal end 59 of the locking member 56. A plurality of first radial teeth 80 are cut into the shoulder 79.

Figure 6:
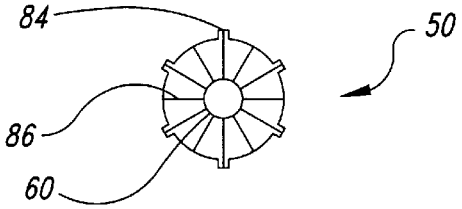
FIG. 6 is an end elevation view of a coupling of the electrical connector of FIG. 3, viewed along Section 6—6.

FIGS. 3 and 6 best illustrate the coupling 50. A plurality of second external teeth 84 are generally oriented about the perimeter of the coupling 50. The second external teeth 84 can be positioned to align with the channels 74 and the locking stops 76 (FIG. 4). In the illustrated embodiment, six second external teeth 84 are evenly spaced about the perimeter of the coupling. The coupling 50, however, may have more or fewer second external teeth 84 depending on the application. The size of the coupling 50 and the second external teeth 84 can be small enough to slide axially within both the channels 74 and the locking stops 76. As a result, the locking stops 76 generally do not prevent the coupling 50 from sliding along the entire length of the internal teeth 52. The coupling 50 can have a plurality of second radial teeth 86 configured to mate with the first radial teeth 80 on the locking member 56.

Figure 7:
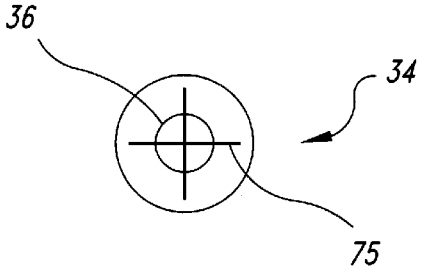
FIG. 7 is an end elevation view of a casing of the electrical connector of FIG. 3, viewed along Section 7—7.

FIGS. 3 and 7 best illustrate the casing 34. A distal end 73 of the casing 34 (FIG. 3) can be tapered radially inward to form a substantially conical portion connected at its apex to the elongated members 36. The distal portion 73 of the casing 34 can have a number of elongated cuts 75 extending in a proximal direction from the extreme distal tip of the casing 34. The embodiment illustrated in FIG. 7 has two cuts 75, dividing the distal end 73 of the casing 34 into four independent sections. The cuts 75 can completely sever the distal end 75 of the casing 34 to allow the casing to be expanded radially outward.

Figure 8:
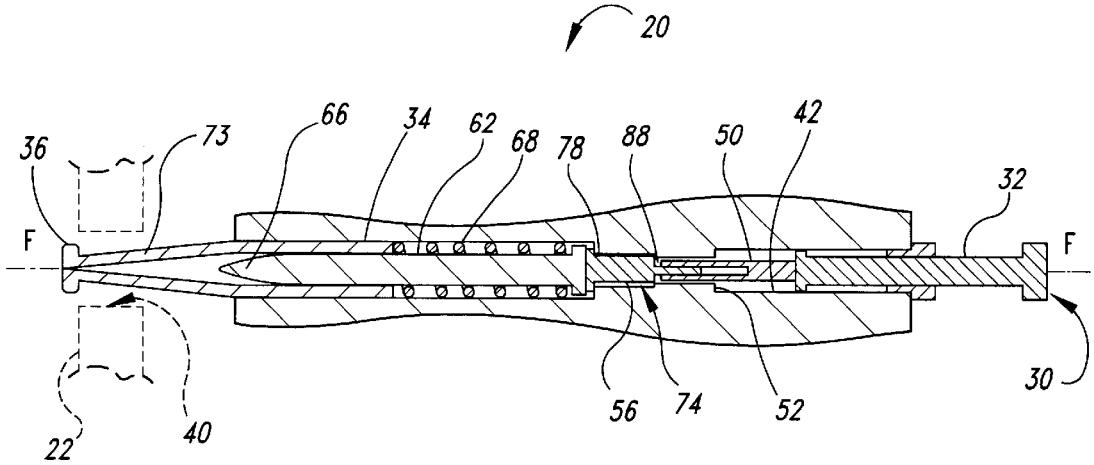
FIGS. 8–10 are enlarged cross-sectional views of a portion of the electrical connector of FIG. 2 engaged with an orifice on a computer component, shown in varying configurations.
Figure 9:
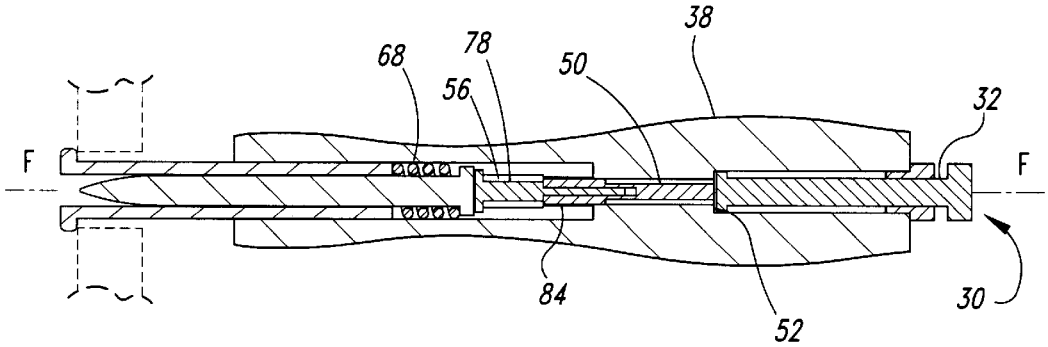
Figure 10:
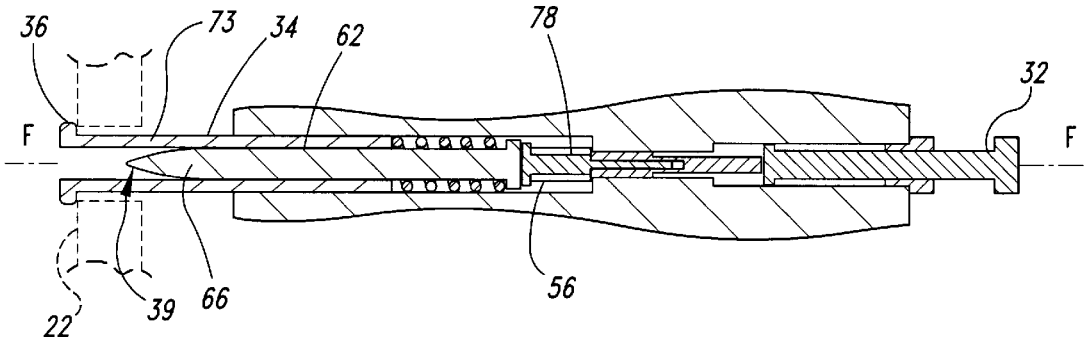
Figure 11:
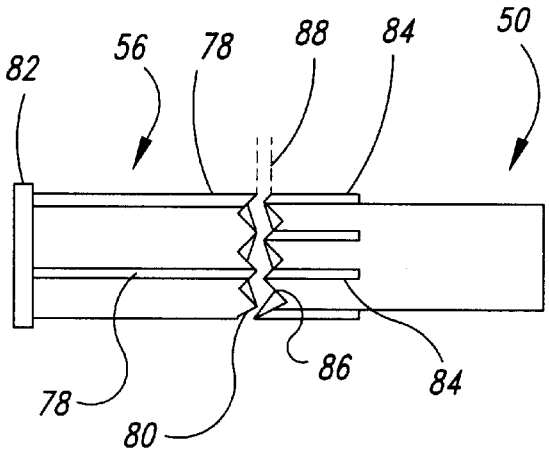
FIG. 11 is a side elevation view of the locking member and the coupling of the electrical connector as configured in FIG. 8.

FIGS. 8–12 illustrate the operation of the fastener 30. In FIG. 8, the first actuator 32 is in the first position and the casing 34 is in the release position. In this configuration, the first external teeth 78 on the locking member 56 are aligned with the empty channels 74, allowing the locking member 56 to fully engage the internal teeth 52 of the aperture 42. The first external teeth 78 are also aligned with the second external teeth 84 within the channels 74 (FIG. 11). The angular displacement between the first and second radial teeth 80,86 can create an axial gap 88 between the locking member 56 and the coupling 50 (FIG. 11). The spring 68 generally urges the second actuator 62 against the locking member 56 (FIG. 8) and, in turn, the flange 82 (FIG. 3) of the locking member 56 against the internal teeth 52. In the release position shown in FIG. 8, the distal end 66 of the second actuator 62 is separated from the distal end 73 of the casing 34. The distal end 73 of the casing 34 is generally shaped such that the engagement members 36 are near the fastening axis F—F when the casing 34 is in the release position. In this configuration, the engagement elements 36 can be passed through the opening 40 in the computer component 22.

Figure 12:
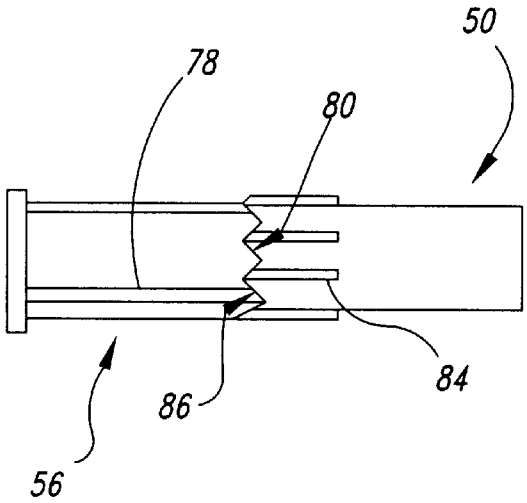
FIG. 12 is a side elevation view of the locking member and the coupling of the electrical connector as configured in FIG. 9.

Referring to FIG. 9, the fastener 30 is in an intermediate position between the release position and the fasten position. In the intermediate position, the first actuator 32 is displaced distally until the first external teeth 78 of the locking member 56 are disengaged from the internal teeth 52. Once the first external teeth 78 on the locking member 56 (FIG. 5) disengage from the internal teeth 52, the pressure of the spring 68 on the locking member 56 can cause the first radial teeth 80 on the locking member 56 to rotate and fully mesh with the second radial teeth 86 on the coupling 50 (FIGS. 11 and 12). The second external teeth 84 on the coupling 50 can engage with the internal teeth 52, preventing the coupling 50 from rotating about the fastening axis F—F with respect to the body 38. Rotation of the locking member 56 with respect to the coupling 50 consequently results in the locking member 56 rotating with respect to the body 38 and the internal teeth 52. The first external teeth 78 therefore are caused to subsequently align with the locking stops 76 (FIG. 4).

FIG. 10 illustrates the second actuator 32 after it has been released from the configuration of FIG. 9, leaving the second actuator in the second position and the casing 34 in the fasten position. The first external teeth 78 can engage with the locking stops 76 (FIG. 4) to prevent the locking member 56 from moving along the fastening axis F—F in the proximal direction with respect to the casing 34. The locking member 56 can axially displace the second actuator 62 in the distal direction to cause a driving surface 39 on the second actuator to expand the distal end 73 of the casing 34 radially outward. When the distal end 73 of the casing 34 is expanded, the engagement elements 36 generally move away from the fastening axis F—F and hold the fastener to the computer component 22.

To move the first actuator 32 back to the first position and the casing 34 back to the release position, the first actuator 32 can be depressed and released one additional time. When the first actuator 32 is depressed, the locking member 56 is generally separated from the internal teeth 52 and, as described above in connection with FIG. 9, the locking member 56 can rotate to align the first external teeth 78 with the channels 74. When the first actuator 32 is released, a restoring force in the spring 68 can move the second actuator 62 and the locking member 56 proximally until the flange 82 (FIG. 5) contacts the internal teeth. The fastener 30 is at this point in the release position.

This embodiment of the fastener 30 can be manipulated between the release and fasten positions with only axial movement of the first actuator. Because this embodiment of the fastener can be alternatingly manipulated to move between the release position and the fasten position by merely axially depressing and releasing the first actuator, the electrical connector can be locked to and unlocked from the computer component without rotating a portion of the fastener. The fastener of the present invention, therefore, is expected to be easily manipulated by an individual even when the computer component is positioned adjacent a wall and/or beneath a desk.

This embodiment of the fastener 30 is also expected to be more durable than existing quick-release type fasteners. The casing and the engagement members in this particular embodiment can be fabricated from metal, plastic or other durable materials. As such, the casing and engagement members should last considerably longer than pressure-extrudable elastomeric materials. These materials may also provide a positive, long-lasting connection between the electrical connector and the computer component.

Figure 13:
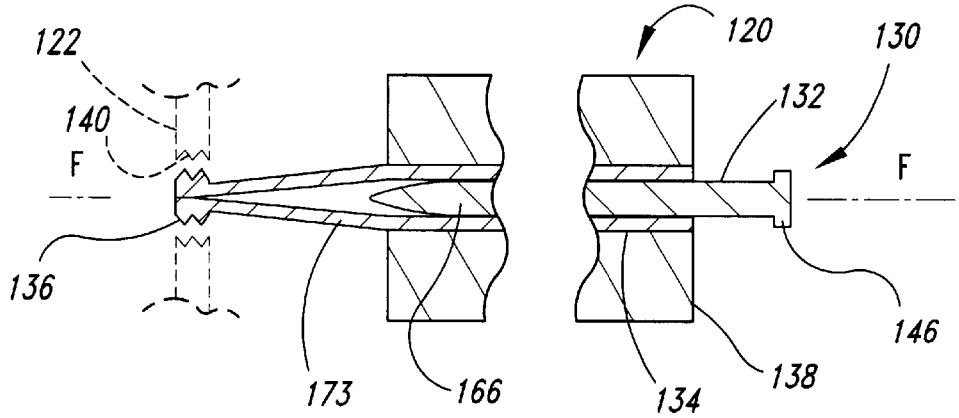
FIG. 13 is a cross-sectional view of a portion of an electrical connector according to another embodiment of the present invention in a release position engaged with a computer component.

FIG. 13 illustrates a portion of an electrical connector 120 and a fastener 130 according to another embodiment of the present invention. In this particular embodiment, the connector 120 has a body 138 similar to that described above, and the fastener 130 includes a casing 134 engaged with the body 138 and an actuator 132. The casing 134 has a distal end 173 that projects beyond the body along a fastening axis F—F, and the extreme portion of the distal end 173 has a number of engagement elements 136. The engagement elements 136 are shaped to closely conform to a threaded opening 140 on a computer component 122. FIG. 13 illustrates the fastener 130 in a release position in which the casing 134 and the engagement elements 136 are configured to be received within the threaded opening 140 when the electrical connector 120 is engaged with the computer component 122.

The actuator 132 is slidably engaged within the casing 134. The actuator 132 can have a proximal end 146 configured to be manipulated by an individual and a distal end 166 having a tapered surface. The illustrated actuator 132 is shown in a first position in which the casing 134 and engagement elements 136 are in the release position.

Figure 14:
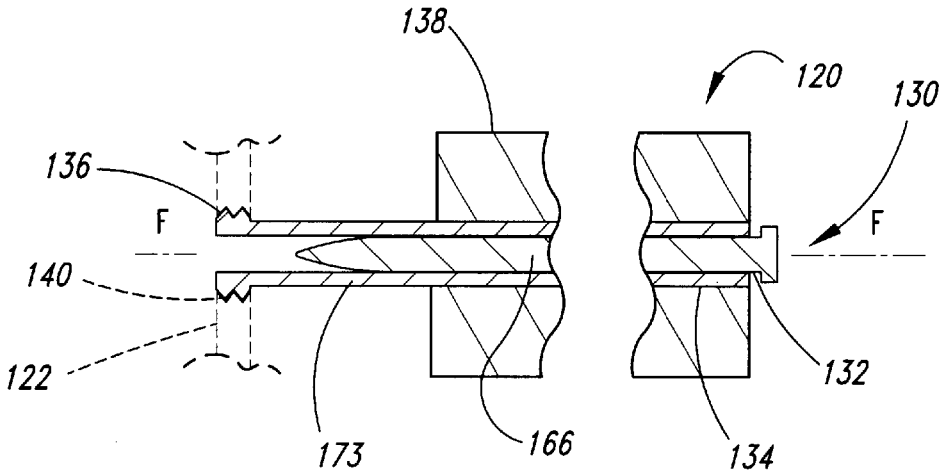
FIG. 14 is a cross-sectional view of the electrical connector of FIG. 13 in a fasten position engaged with the computer component.

FIG. 14 illustrates the electrical connector 120 and the fastener 130 in a fasten position. In the fasten position, the actuator 132 is displaced distally with respect to the release position until the tapered surface at the distal end 166 of the actuator 132 deflects the distal end 173 of the casing 134 to engage the engagement elements 136 with the threaded opening 140 in the computer component 122. The displacement of the distal end 173 of the casing 134 exerts a residual force on the actuator 132 that prevents the actuator from returning automatically from the second position to the first position. The interior wall of the casing 134 and the distal end 166 of the actuator 132 can be configured with a Morse taper to enhance the frictional contact between the actuator 132 and the casing 134.

To move the casing 134 and the engagement elements 136 back to the release position, the user merely moves the actuator 132 proximally until the residual forces in the casing 134 return the engagement elements 136 to the release position. The fastener 130 is now in the release position and the electrical connector 120 can be removed from the computer component 122.

Figure 15:
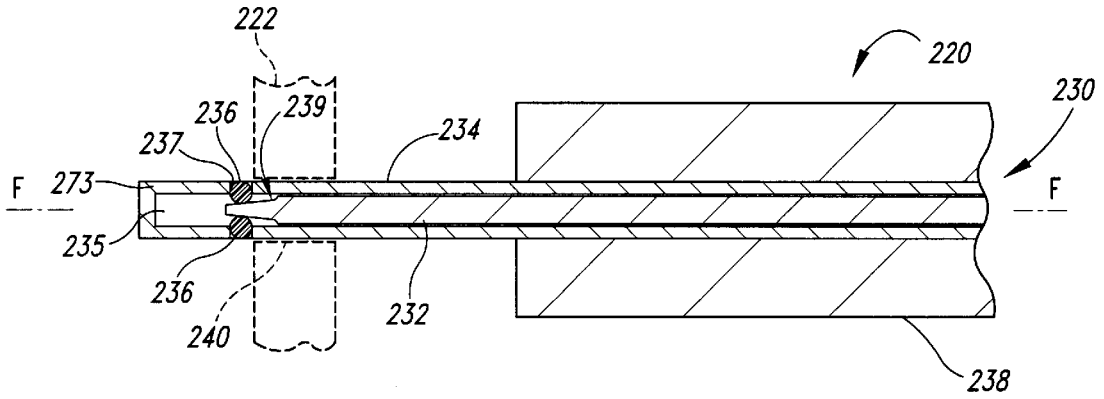
FIG. 15 is a cross-sectional view of a portion of an electrical connector according to yet another embodiment of the present invention in a release position engaged with a computer component.

FIG. 15 illustrates a portion of an electrical connector 220 and a fastener 230 according to yet another embodiment of the present invention in a release position. In this embodiment, the fastener 230 includes a casing 234 that extends through a body 238 and projects distally along a fastening axis F—F from the body 238. The casing 234 is configured to engage an opening 240 in a computer component 222 when the electrical connector 220 is engaged with the computer component 222. The fastener 230 can also have an actuator 232 slidably received within a bore 235 in the casing 234. The actuator 232 can be manipulated at its proximal end (not shown) to move between a first position and a second position, and the actuator 232 can be retained in both the first and second positions as described above with reference to the actuator 32 shown in FIGS. 1–12. The casing 234 has a number of openings 237 near its distal end 273 that are positioned within the computer component 222 when the electrical connector 220 is engaged with a computer component 222. The fastener 230 can also have a number of engagement elements 236 within the bore 235 in alignment with the engagement openings 237. In the release position, the connector 220 is configured to be engaged with and disengaged from the computer component 222.

Figure 16:
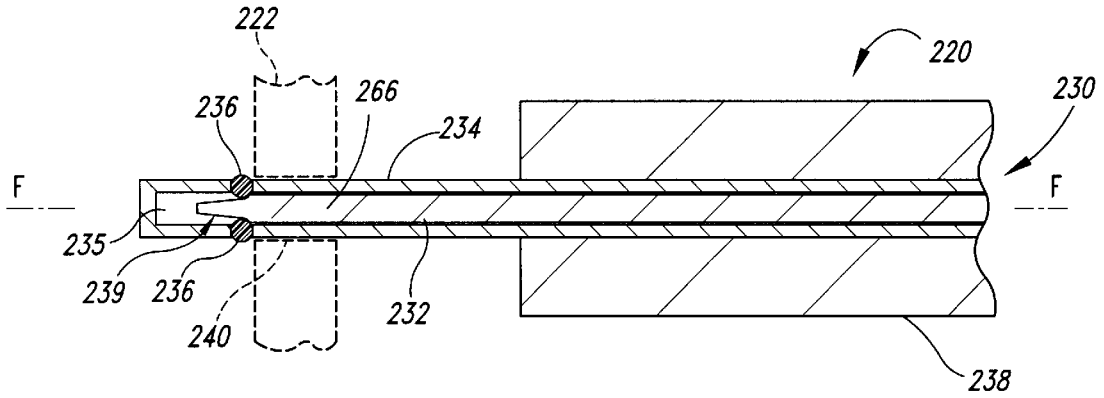
FIG. 16 is a cross-sectional view of the electrical connector of FIG. 15 in a fasten position engaged with the computer component.

FIG. 16 illustrates the electrical connector 220 and the fastener 230 in a fasten position. In the fasten position, the actuator 232 is displaced distally along the fastening axis F—F with respect to the release position until a displacement surface 239 at the distal end 266 of the actuator 232 radially displaces the engagement elements 236 outward. The engagement openings 237 (FIG. 15) are sized to allow the engagement elements 236 to project partially from the casing 234, but are too small for the engagement elements 236 to pass completely through the casing 234. In the fasten position, the engagement elements 236 prevent the electrical connector 220 from being removed from the computer component 222.

Figure 17:
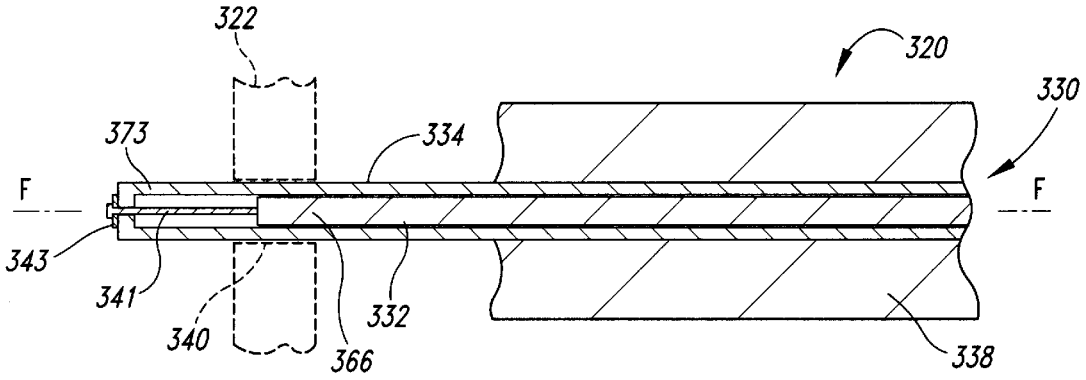
FIG. 17 is a cross-sectional view of a portion of an electrical connector according to still another embodiment of the present invention in a release position engaged with a computer component.

FIG. 17 illustrates a portion of still another embodiment of an electrical connector 320 and a fastener 330 of the present invention. In this particular embodiment, the fastener 330 has a casing 334 engaged with a body 338 of the electrical connector 320 and an actuator 332 slidably received within the casing 334. The casing 334 is shown in a release position in which it is configured to be inserted into and removed from an opening 340 in a computer component 322. A distal end 366 of the actuator 332 is attached by an engagement coupling 341 to a distal end 373 of the casing 334. The distal end 373 of the casing 334 is a flexible material that can be manually distorted. A washer 343 is positioned external to the distal end 373 of the casing 334 and is connected to the engagement coupling 341. The actuator 332 can be manipulated by a user at a proximal end (not shown) to move between and releasably remain in a first position and a second position.

Figure 18:
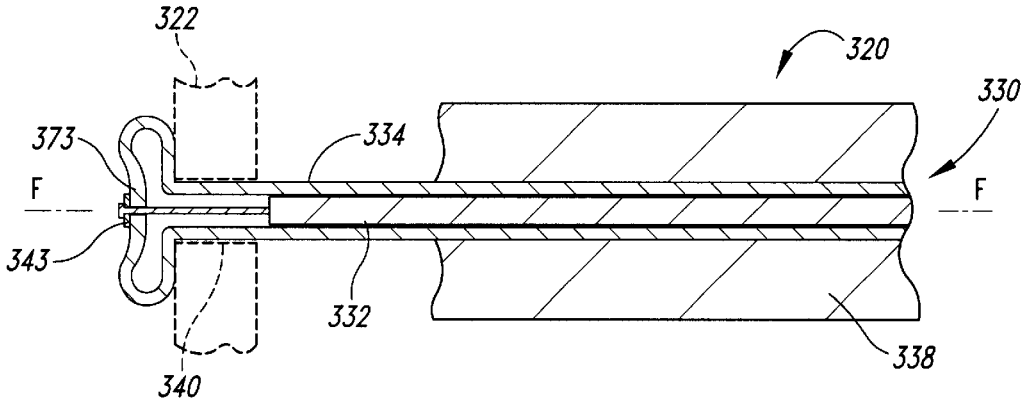
FIG. 18 is a cross-sectional view of the electrical connector of FIG. 17 in a fasten position engaged with the computer component.

FIG. 18 illustrates the electrical connector 320 and the fastener 330 in a fasten position. The user moves the fastener 330 into the fasten position by moving the actuator 332 proximally from the first position to the second position. The distal end 373 of the casing 334 deforms radially outwardly from the fastening axis F—F as the actuator 332 moves in a proximal direction along the fastening axis F—F from the first position to the second position. The washer 343 displaces the distal end of the casing generally radially with respect to the fastening axis F—F when the actuator 332 is in the fasten position. The distal end 373 of the casing 334 can similarly be a hinged coupling, such as a toggle, that moves between the release and fasten positions when the actuator 332 is moved between the first and second positions, respectively. When the fastener 330 is engaged with the computer component 322 and the casing 334 is in the fasten position, the radially displaced portion of the casing 334 holds the fastener 330 to the computer component 322. This consequently prevents the electrical connector 320 from disengaging from the computer component 322. To move the fastener 330 back to the release position, the user moves the actuator 332 axially from the second position to the first position and the resilient material of the distal end 373 of the casing 334 returns generally to the release position allowing the fastener 330 to be removed from the computer component 322.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A fastener for releasably coupling a first electrical contact on a cable with a second electrical contact on a computer component, the computer component having an attachment orifice defining a fastening axis, the fastener comprising:

a body having an aperture through which the first electrical contact projects and a grip configured to be manipulated by the human hand;

an elongated casing projecting from the body along the fastening axis when the first electrical contact is engaged with the second electrical contact;

at least a first engagement element positioned along the casing at a location spaced apart from the body, at least one of the casing or the engagement element being moveable between a release position in which the engagement element is proximate to the fastening axis and configured to be received in the orifice and a fasten position in which at least a portion of the engagement element is spaced laterally apart from the fastening axis; and at least a first actuator including a first end accessible to a user, a second end adjacent to the casing, and a drive surface at the second end coupleable with at least one of the first engagement element or the casing, the first actuator being slidably coupled to the body to move only axially between a first position in which the first engagement element is in the release position and can be received in the orifice and a second position in which the drive surface moves the one of the first engagement element or the casing to position the first engagement element or casing in the fasten position when at least a portion of the casing is received in the orifice to engage the first engagement element with at least one of the orifice or the computer component.

2. The fastener of claim 1, further comprising:

a second actuator axially aligned with the first actuator and slidably coupled with the casing, the second actuator having first and second ends, the second end of the second actuator having a drive surface configured to slidably contact the casing, the second actuator being movable with the first actuator between the first and second positions, and wherein the first end of the first actuator is accessible to the user and the second end of the second actuator is adjacent to the casing; and an axial lock/release mechanism operatively coupling the first actuator to the second actuator, the lock/release mechanism alternatingly holding the second actuator in the second position and releasing the second actuator to the first position solely by axially moving the first actuator from the second position to the first position.

3. The fastener of claim 1, further comprising:

a second actuator axially aligned with the first actuator and slidably coupled with the casing, the second actuator having first and second ends, the second end of the second actuator having a drive surface configured to slidably contact the casing, the second actuator being movable with the first actuator between the first and second positions, and wherein the first end of the first actuator is accessible to the user and the second end of the second actuator is adjacent to the casing; and a locking assembly slidably engaged with the body between the first and second actuators and having first and second ends, the first end of the locking assembly being configured to engage the second end of the first actuator and the second end of the locking assembly being configured to engage the first end of the second actuator, the locking assembly and second actuator being movable with the first actuator to drive the casing or first engagement element radially outward from the release position to the fasten position as the first actuator moves in a distal direction from the first position to the second position.

4. The fastener of claim 3, wherein the body has an aperture having an internal surface with a plurality of internal teeth and a plurality of internal channels interposed between the internal teeth, the first actuator, the locking assembly and the second actuator being slidably engaged with the aperture, the locking assembly having a plurality of external teeth configured to alternatingly engage the internal teeth and the internal channels of the aperture as the first actuator is sequentially actuated to retain the casing or first engagement element in the fasten and release positions, respectively.

5. The fastener of claim 2, wherein the casing is hollow having an internal contact surface, a proximal portion coupled to the body and a distal portion projecting along the fastening axis external to the body, the proximal portion of the casing being configured to receive the second actuator therein, the distal portion of the casing being substantially conical about the fastening axis and having at least one elongated cut extending in a proximal direction from the extreme distal end of the casing such that the drive surface on the second actuator slidably contacts the contact surface on the casing and drives the distal portion of the casing radially outward to move the casing or first engagement element from the release position to the fasten position as the second actuator is moved in a distal direction from the first position to the second position.

6. The fastener of claim 1, wherein the casing is hollow having an internal contact surface, a proximal portion of the casing is coupled to the body and a distal portion projects along the fastening axis to a point external to the body, the proximal portion of the casing being configured to receive the first actuator therein, the distal portion of the casing being substantially conical about the fastening axis and having at least one elongated cut extending in a proximal direction from the extreme distal end of the casing such that the drive surface on the first actuator slidably contacts the contact surface on the casing and drives the distal portion of the casing radially outward to move the casing or first engagement element from the release position to the fasten position as the first actuator moves in a distal direction from the first position to the second position.

7. The fastener of claim 6 usable with a computer component having a threaded attachment orifice, wherein the engagement elements are configured to conform to the threaded attachment orifice and to retain the first electrical contact in engagement with the second electrical contact when the casing is in the fasten position.

8. The fastener of claim 1, wherein the casing is substantially cylindrical and hollow to define an elongated bore, the casing having at least a first engagement opening extending between the bore and a point external to the casing, the first engagement opening being positioned to be received in the engagement orifice when the first electrical contact is coupled to the second electrical contact, wherein the engagement element is sized and shaped to pass partially through the engagement opening and project beyond an external surface of the casing, and wherein the bore in the casing is sized to receive the first actuator therein, the engagement element being aligned with the drive surface on the first actuator such that the drive surface drives the engagement element partially through the engagement opening and the engagement element holds the first electrical connector to the second electrical connector as the first actuator is moved in a distal direction from the first position to the second position.

9. The fastener of claim 1, wherein a distal portion of the casing is received within the attachment orifice when the first electrical contact is coupled with the second electrical contact, the distal portion of the casing being manually bendable between the release position in which the casing is elongated to be received within the attachment orifice and the fasten position in which the distal portion of the casing is bent to hold the first electrical contact to the second electrical contact, the first actuator being coupled to the distal portion of the casing to move the casing from the release position to the fasten position as the first actuator is moved in a proximal direction from the first position to the second position.

10. The fastener of claim 1 wherein the engagement element is moveably coupled to the casing.

11. The fastener of claim 10 wherein the engagement element is connected to the casing.

12. The fastener of claim 11 wherein the engagement element is integral to the casing.

13. The fastener of claim 1 wherein the casing has a distal end oriented furthest from the body and the engagement element is coupled to the distal end of the casing.

14. The fastener of claim 1 wherein the casing has a distal end oriented furthest from the body and the engagement element is coupled to the distal end of the casing, the engagement element projects radially from the casing, and at least a portion of the casing is flexible to move the engagement element between the release and fasten positions.

15. The fastener of claim 1 wherein the drive surface of the actuator is tapered toward the second end of the actuator and at least a portion of the casing is axially aligned with at least a portion of the drive surface such that the drive surface drives the casing radially outwardly to move the engagement element from the release position to the fasten position as the actuator is moved from the first position to the second position.

16. The fastener of claim 15 wherein the drive surface of the actuator is radially inwardly tapered toward the second end.

17. The fastener of claim 1 wherein the casing has a distal end oriented furthest from the body and the engagement element is coupled to the distal end of the casing, the engagement element projects radially from the casing, at least a portion of the casing is flexible to move the engagement element between the release and fasten positions, the drive surface of the actuator is tapered radially inwardly toward the second end of the actuator, and at least a portion of the casing is axially aligned with at least a portion of the drive surface such that the drive surface drives the casing radially outward to flex the engagement element from the release position to the fasten position as the actuator is moved from the first position to the second position.

18. A fastening assembly for releasably retaining an electrical connector in engagement with a computer component, the connector having a body and a first electrical contact configured to be coupled with a complementary second electrical contact on the computer component, the computer component having at least one orifice defining a fastening axis near the second electrical contact, the fastening assembly comprising:

at least a first retaining member projecting from the body generally along the fastening axis when the first electrical contact is engaged with the second electrical contact, the first retaining member having a contact surface oblique with respect to the fastening axis, and the first retaining member being moveable between a release position in which the first retaining member is configured to be received in the orifice and a fasten position in which the first retaining member is expanded to extend laterally away from the fastening axis; and at least a first actuator having a first end with a handling surface and a second end with a drive surface, the drive surface being configured to slidably engage the contact surface on the first retaining member and move the retaining member away from the fastening axis, the actuator being slidably coupled with the body to move axially between a first position in which the first retaining member is in the release position and a second position in which the drive surface slidably engages the contact surface to move the first retaining member to the fasten position in which the retaining member contacts the computer component to hold the connector to the computer component.

19. The fastening assembly of claim 18, further comprising:

a second actuator axially aligned with the first actuator and slidably coupled with the casing, the second actuator having first and second ends, the second end of the second actuator having a drive surface configured to slidably contact the casing, the second actuator being movable with the first actuator between the first and second positions, and wherein the first end of the first actuator is accessible to the user and the second end of the second actuator is adjacent to the casing; and an axial lock/release mechanism operatively coupling the first actuator to the second actuator, the lock/release mechanism alternatingly holding the second actuator in the second position and releasing the second actuator to the first position solely by axially moving the first actuator from the second position to the first position.

20. The fastening assembly of claim 18, further comprising:

a second actuator axially aligned with the first actuator and slidably coupled with the casing, the second actuator having first and second ends, the second end of the second actuator having a drive surface configured to slidably contact the casing, the second actuator being movable with the first actuator between the first and second positions, and wherein the first end of the first actuator is accessible to the user and the second end of the second actuator is adjacent to the casing; and a locking assembly slidably engaged with the body between the first and second actuators and having first and second ends, the first end of the locking assembly being configured to engage the second end of the first actuator and the second end of the locking assembly being configured to engage the first end of the second actuator, the locking assembly and second actuator being movable with the first actuator to drive the casing or first engagement element radially outward from the release position to the fasten position as the first actuator moves in a distal direction from the first position to the second position.

21. The fastening assembly of claim 20, wherein the body has an aperture having an internal surface with a plurality of internal teeth and a plurality of internal channels interposed between the internal teeth, the first actuator, the locking assembly and the second actuator being slidably engaged with the aperture, the locking assembly having a plurality of external teeth configured to alternatingly engage the internal teeth and the internal channels of the aperture as the first actuator is sequentially actuated to retain the casing or first engagement element in the fasten and release positions, respectively.

22. The fastening assembly of claim 19, wherein the casing is hollow having an internal contact surface, a proximal portion coupled to the body and a distal portion projecting along the fastening axis external to the body, the proximal portion of the casing being configured to receive the second actuator therein, the distal portion of the casing being substantially conical about the fastening axis and having at least one elongated cut extending in a proximal direction from the extreme distal end of the casing such that the drive surface on the second actuator slidably contacts the contact surface on the casing and drives the distal portion of the casing radially outward to move the casing or first engagement element from the release position to the fasten position as the second actuator is moved in a distal direction from the first position to the second position.

23. The fastening assembly of claim 18, wherein the casing is hollow having an internal contact surface, a proximal portion of the casing is coupled to the body and a distal portion projects along the fastening axis external to the body, the proximal portion of the casing being configured to receive the first actuator therein, the distal portion of the casing being substantially conical about the fastening axis and having at least one elongated cut extending in a proximal direction from the extreme distal end of the casing such that the drive surface on the first actuator slidably contacts the contact surface on the casing and drives the distal portion of the casing radially outward to move the casing or first engagement element from the release position to the fasten position as the first actuator moves in a distal direction from the first position to the second position.

24. The fastening assembly of claim 23 usable with a computer component having a threaded attachment orifice, wherein the engagement elements are configured to conform to the threaded attachment orifice and to retain the first electrical contact in engagement with the second electrical contact when the casing is in the fasten position.

25. An electrical connector for a computer component having a first electrical contact and at least one attachment orifice near the first electrical contact, the attachment orifice defining a fastening axis, the electrical connector comprising:

a body having an aperture through which the first electrical contact projects and a grip configured to be manipulated by the human hand;

an elongated casing projecting from the body along the fastening axis when the first electrical contact is engaged with the second electrical contact;

at least a first engagement element positioned along the casing at a location spaced apart from the body, at least one of the casing or the engagement element being moveable between a release position in which the engagement element is proximate to the fastening axis and configured to be received in the orifice and a fasten position in which at least a portion of the engagement element is spaced laterally apart from the fastening axis; and at least a first actuator including a first end accessible to a user, a second end adjacent to the casing, and a drive surface at the second end coupleable with at least one of the first engagement element or the casing, the first actuator being slidably coupled to the body to move only axially between a first position in which the first engagement element is in the release position and can be received in the orifice and a second position in which the drive surface moves the one of the first engagement element or the casing to position the first engagement element or casing in the fasten position when at least a portion of the casing is received in the orifice to engage the first engagement element with at least one of the orifice or the computer component.

26. The electrical connector of claim 25, further comprising:

a second actuator axially aligned with the first actuator and slidably coupled with the casing, the second actuator having first and second ends, the second end of the second actuator having a drive surface configured to slidably contact the casing, the second actuator being movable with the first actuator between the first and second positions, and wherein the first end of the first actuator is accessible to the user and the second end of the second actuator is adjacent to the casing; and an axial lock/release mechanism operatively coupling the first actuator to the second actuator, the lock/release mechanism alternatingly holding the second actuator in the second position and releasing the second actuator to the first position solely by axially moving the first actuator from the second position to the first position.

27. The electrical connector of claim 25, further comprising:

a second actuator axially aligned with the first actuator and slidably coupled with the casing, the second actuator having first and second ends, the second end of the second actuator having a drive surface configured to slidably contact the casing, the second actuator being movable with the first actuator between the first and second positions, and wherein the first end of the first actuator is accessible to the user and the second end of the second actuator is adjacent to the casing; and a locking assembly slidably engaged with the body between the first and second actuators and having first and second ends, the first end of the locking assembly being configured to engage the second end of the first actuator and the second end of the locking assembly being configured to engage the first end of the second actuator, the locking assembly and second actuator being movable with the first actuator to drive the casing or first engagement element radially outward from the release position to the fasten position as the first actuator moves in a distal direction from the first position to the second position.

28. The electrical connector of claim 26, wherein the casing is hollow having an internal contact surface, a proximal portion coupled to the body and a distal portion projecting along the fastening axis external to the body, the proximal portion of the casing being configured to receive the second actuator therein, the distal portion of the casing being substantially conical about the fastening axis and having at least one elongated cut extending in a proximal direction from the extreme distal end of the casing such that the drive surface on the second actuator slidably contacts the contact surface on the casing and drives the distal portion of the casing radially outward to move the casing or first engagement element from the release position to the fasten position as the second actuator is moved in a distal direction from the first position to the second position.

29. The electrical connector of claim 25, wherein the casing is substantially cylindrical and hollow to define an elongated bore, the casing having at least a first engagement opening extending between the bore and a point external to the casing, the first engagement opening being positioned to be received in the engagement orifice when the first electrical contact is coupled to the second electrical contact, wherein the engagement element is sized and shaped to pass partially through the engagement opening and project beyond an external surface of the casing, and wherein the bore in the casing is sized to receive the first actuator therein, the engagement element being aligned with the drive surface on the first actuator such that the drive surface drives the engagement element partially through the engagement opening and the engagement element holds the first electrical connector to the second electrical connector as the first actuator is moved in a distal direction from the first position to the second position.

30. The electrical connector of claim 25, wherein a distal portion of the casing is received within the attachment orifice when the first electrical contact is coupled with the second electrical contact, the distal portion of the casing being manually bendable between the release position in which the casing is elongated to be received within the attachment orifice and the fasten position in which the distal portion of the casing is bent to hold the first electrical contact to the second electrical contact, the first actuator being coupled to the distal portion of the casing to move the casing from the release position to the fasten position as the first actuator is moved in a proximal direction from the first position to the second position.

31. A computer system comprising:

a computer having a central processing unit and at least one memory device, the central processing unit having a first electrical contact and at least one attachment orifice near the first electrical contact, the attachment orifice defining a fastening axis; and a cable for connecting the computer to a peripheral computer component, the cable comprising:

an electrical connector having a body, the body having an aperture through which the first electrical contact projects and a grip configured to be manipulated by the human hand;

an elongated casing projecting from the body along the fastening axis when the first electrical contact is engaged with the second electrical contact;

at least a first engagement element positioned along the casing at a location spaced apart from the body, at least one of the casing or the engagement element being moveable between a release position in which the engagement element is proximate to the fastening axis and configured to be received in the orifice and a fasten position in which at least a portion of the engagement element is spaced laterally apart from the fastening axis; and at least a first actuator including a first end accessible to a user, a second end adjacent to the casing, and a drive surface at the second end coupleable with at least one of the first engagement element or the casing, the first actuator being slidably coupled to the body to move only axially between a first position in which the first engagement element is in the release position and can be received in the orifice and a second position in which the drive surface moves the one of the first engagement element or the casing to position the first engagement element or casing in the fasten position when at least a portion of the casing is received in the orifice to engage the first engagement element with at least one of the orifice or the computer component.

32. The computer system of claim 31, further comprising:

a second actuator axially aligned with the first actuator and slidably coupled with the casing, the second actuator having first and second ends, the second end of the second actuator having a drive surface configured to slidably contact the casing, the second actuator being movable with the first actuator between the first and second positions, and wherein the first end of the first actuator is accessible to the user and the second end of the second actuator is adjacent to the casing; and an axial lock/release mechanism operatively coupling the first actuator to the second actuator, the lock/release mechanism alternatingly holding the second actuator in the second position and releasing the second actuator to the first position solely by axially moving the first actuator from the second position to the first position.

33. The computer system of claim 32, further comprising:

a second actuator axially aligned with the first actuator and slidably coupled with the casing, the second actuator having first and second ends, the second end of the second actuator having a drive surface configured to slidably contact the casing, the second actuator being movable with the first actuator between the first and second positions, and wherein the first end of the first actuator is accessible to the user and the second end of the second actuator is adjacent to the casing; and a locking assembly slidably engaged with the body between the first and second actuators and having first and second ends, the first end of the locking assembly being configured to engage the second end of the first actuator and the second end of the locking assembly being configured to engage the first end of the second actuator, the locking assembly and second actuator being movable with the first actuator to drive the casing or first engagement element radially outward from the release position to the fasten position as the first actuator moves in a distal direction from the first position to the second position.

34. The computer system of claim 32, wherein the casing is hollow having an internal contact surface, a proximal portion coupled to the body and a distal portion projecting along the fastening axis external to the body, the proximal portion of the casing being configured to receive the second actuator therein, the distal portion of the casing being substantially conical about the fastening axis and having at least one elongated cut extending in a proximal direction from the extreme distal end of the casing such that the drive surface on the second actuator slidably contacts the contact surface on the casing and drives the distal portion of the casing radially outward to move the casing or first engagement element from the release position to the fasten position as the second actuator is moved in a distal direction from the first position to the second position.

35. The computer system of claim 31, wherein the casing is substantially cylindrical and hollow to define an elongated bore, the casing having at least a first engagement opening extending between the bore and a point external to the casing, the first engagement opening being positioned to be received in the engagement orifice when the first electrical contact is coupled to the second electrical contact, wherein the engagement element is sized and shaped to pass partially through the engagement opening and project beyond an external surface of the casing, and wherein the bore in the casing is sized to receive the first actuator therein, the engagement element being aligned with the drive surface on the first actuator such that the drive surface drives the engagement element partially through the engagement opening and the engagement element holds the first electrical connector to the second electrical connector as the first actuator is moved in a distal direction from the first position to the second position.

36. The computer system of claim 31, wherein a distal portion of the casing is received within the attachment orifice when the first electrical contact is coupled with the second electrical contact, the distal portion of the casing being manually bendable between the release position in which the casing is elongated to be received within the attachment orifice and the fasten position in which the distal portion of the casing is bent to hold the first electrical contact to the second electrical contact, the first actuator being coupled to the distal portion of the casing to move the casing from the release position to the fasten position as the first actuator is moved in a proximal direction from the first position to the second position.

* * * * *

UNITED STATES PATENT AND TRADEMARK OFFICE

CERTIFICATE OF CORRECTION

PATENT NO. : 6,482,024 B1
DATED : November 19, 2002
INVENTOR(S) : Paul A. Revis

It is certified that error appears in the above-identified patent and that said Letters Patent is hereby corrected as shown below:

Title page,
Item [54], Title, "FASTENING AND" should be -- FASTENING AN --;
Item [56], References Cited, U.S. PATENT DOCUMENTS, "5,383,792" should be -- 5,383,795 --;

Signed and Sealed this

Fifteenth Day of March, 2005

JON W. DUDAS
*Director of the United States Patent and Trademark Office*